US007520569B2

(12) United States Patent
Han

(10) Patent No.: US 7,520,569 B2
(45) Date of Patent: Apr. 21, 2009

(54) CHAIR WITH A COMBINATION BACK SUPPORT AND COVER PLATE

(75) Inventor: Sang Cheol Han, Seoul (KR)

(73) Assignee: Jae Young Machinery Co., Ltd., Incheon (KR)

( * ) Notice: Subject to any disclaimer, the term of this patent is extended or adjusted under 35 U.S.C. 154(b) by 443 days.

(21) Appl. No.: 10/553,772

(22) PCT Filed: Dec. 2, 2004

(86) PCT No.: PCT/KR2004/003161

§ 371 (c)(1),
(2), (4) Date: Oct. 19, 2005

(87) PCT Pub. No.: WO2005/053462

PCT Pub. Date: Jun. 16, 2005

(65) Prior Publication Data

US 2007/0007809 A1 Jan. 11, 2007

(30) Foreign Application Priority Data

Dec. 2, 2003 (KR) ..... 20-2003-0037577

(51) Int. Cl.
*B60N 2/02* (2006.01)

(52) U.S. Cl. ..... 297/378.14; 297/332

(58) Field of Classification Search ..... 297/378.14, 297/378.1, 316, 332, 331, 248
See application file for complete search history.

(56) References Cited

U.S. PATENT DOCUMENTS

| | | | | |
|---|---|---|---|---|
| 878,889 | A * | 2/1908 | Miller | 297/352 |
| 3,744,843 | A * | 7/1973 | Barecki et al. | 297/316 |
| 4,765,679 | A * | 8/1988 | Lanuzzi et al. | 297/300.3 |
| 4,775,187 | A * | 10/1988 | Herr | 297/378.14 |
| 5,887,946 | A | 3/1999 | Raftery | |
| 5,988,746 | A | 11/1999 | Raftery | |
| 6,494,539 | B2 * | 12/2002 | Frank | 297/378.1 |

FOREIGN PATENT DOCUMENTS

| | | |
|---|---|---|
| JP | 07-177942 | 7/1995 |
| JP | 07177942 | 7/1995 |
| JP | 07-301015 | 11/1995 |
| JP | 07301015 | 11/1995 |
| JP | 09-187346 | 7/1997 |
| JP | 09187346 | 7/1997 |
| KR | 1020020076617 | 10/2002 |

* cited by examiner

*Primary Examiner*—Milton Nelson, Jr.
(74) *Attorney, Agent, or Firm*—IPLA P.A.; James E. Bame

(57) ABSTRACT

A chair with a combination back support and cover plate is provided, which solves a burdensome affair that a user consistently holds up a back support folded on a seat until he or she sits on the seat, makes the back support automatically folded on the seat after use of the seat, to thereby enhance convenience of use, and prevents the back support from being unfolded upwards from the state where the back support has been folded on the seat due to wind, to thereby prevent the seat from being polluted due to dust or rainwater.

10 Claims, 11 Drawing Sheets

CHAIR WITH A COMBINATION BACK SUPPORT AND COVER PLATE

TECHNICAL FIELD

The present invention relates to a chair with a combination back support and cover plate, and more particularly to, a chair with a combination back support and cover plate in which a back support hinged with and supported by a seat is automatically closely attached to the seat after use of the seat, to thereby prevent the seat from being polluted by dust or rainwater and to thus convenience management of the chair.

BACKGROUND ART

In general, there are chairs in a place where a number of people use such as a playground stand, an open theater, a park, etc.

Since the chairs which are installed in the above-described places are exposed in the outdoor environment, it is general to use chairs made of plastic materials having an excellent durability. These chairs are constituted by only a seat, or made of a seat and a back support which are integrally formed, respectively.

However, since the chairs are exposed in the outdoor environment, dust may be collected on the chairs, or the chairs may be wet due to the rain or snow, which causes it inconvenient to manage the chairs.

To solve the problem that the chairs are wet due to the rain or snow among the above-described problems, a seat is formed with an inclined structure to prevent rainwater from being collected, or is formed with the central portion positioned at a low position and having a drain hole to prevent rainwater from being collected. However, it is difficult to prevent the seat from being polluted due to foreign matters such as dust.

Thus, in order to prevent the seat from being polluted due to dust or rainwater, there has been introduced a chair having a structure that a back support hinged and connected with the rear end of a seat is used as a back support when the chair is used as a seat, and is used as a cover plate for the seat when the chair is not used as a seat.

However, in the case of a chair which employs a combined use of a back support as a cover plate for covering a seat of the chair in which the seat and the back support are hinged and connected with each other, a user should fold the back support to cover the seat with it. This causes difficulties of management of chairs.

In order to solve the problems, the same applicant as that of the present invention developed and filed Korean Patent Application No. 2001-16600 on 29 Mar. 2001 (Korean Laid-open Patent Publication No. 2002-76617 published on 11 Oct. 2002), entitled "A chair with a combination back support and cover plate." Here, a twist spring is installed in a hinge pin combined between a back support and a seat. Accordingly, in the case that a user stands up from a riding state on the seat, the back support is automatically folded on the seat.

However, since the back support is always elastically supported on the upper surface of the seat by the twist spring, a user who wishes to sit on the seat should raise up the back support with one hand until he or she sits thereon.

DISCLOSURE OF INVENTION

To solve the above problems, it is an object of the present invention to provide a chair with a combination back support and cover plate which solves a burdensome affair that a user consistently holds up a back support folded on a seat until he or she sits on the seat, makes the back support automatically folded on the seat after use of the seat, to thereby enhance convenience of use, and prevents the back support from being unfolded upwards from the state where the back support has been folded on the seat due to wind, to thereby prevent the seat from being polluted due to dust or rainwater.

It is another object of the present invention to provide a chair with a combination back support and cover plate which provides a seat with an elastic force to make a comfortable sitting state, and makes a back support being folded at low speed at the process of automatically covering the upper surface of the seat with the back support after use of the seat, to thereby prevent the chair from being damaged and causing noise to be generated due to the mechanical shock which may happen between the back support and the seat at high speed.

To accomplish the above object of the present invention, according to the present invention, there is provided a chair with a combination back support and cover plate comprising: a frame whose lower part is fixed to another object; a seat which is installed on the upper portion of the frame; a back support which is hinged and connected with one end of the seat; a hinge portion which connects the seat and the back support by means of hinge connection; an elastic support unit which is installed between the seat and the frame, for elastically supporting the seat; a closing unit which pulls the back support toward the seat if the front end of the seat moves up by the elastic support unit when a user stands up from the seat; and a slow-downer which is connected with the hinge portion and the back support, to slow down the back support at low speed.

The closing unit comprises: a support unit which is installed in the lower middle portion of the seat so that the rear end of the seat moves up and down reversely when the front end of the seat moves up and down by the elastic support unit and a user's weight; a knob which protrudes in the lower end of the back support; and a stopper which is installed in the frame at the position where the knob contacts at the state that the back support has been unfolded.

The stopper is formed of a bolt which is combined with the frame by means of a screw so that a gap between the knob and the stopper can be adjusted, and whose one end contact the knob. Otherwise, the stopper is formed of a plate which is installed in the frame so as to adjust a gap between the knob and the stopper and contacts the knob, and a fixing unit which movably fixes the plate to the frame.

The closing unit comprises: a link whose one end is rotatably connected with the hinge portion and contacts the lower end of the back support; a pushing rod on one end of which the fixing unit is formed and with the other end of which the link is connected; a spring which is mounted on the pushing rod; a spring stopper to one end of which the frame is fixed and to the other end of which one end of the spring is fixed, to thereby support the pushing rod; a rod stopper which is connected with the other end of the spring and fixed to the pushing rod; a hook which is installed in the frame and is connected with the fixing unit which is formed in one end of the pushing rod; a hook spring which is connected between one end of the hook and the frame, for pulling the hook toward the seat; and a hook release unit which is installed below the seat and separates the hook from the fixing unit in the pushing rod by a user's weight when a user sits on the seat.

The present invention further comprises a limit unit which limits a moving range by the elastic support unit between the front end of the seat and the frame.

The present invention further comprises a magnet or magnetic body which is installed in opposition to each other in both the seat and the back support, respectively.

The elastic support unit comprises: a housing to the upper end of which the fixed frame is fixed; a spring which is installed in the inside of the housing; and a pusher which is directed toward the seat by the spring.

The elastic support unit is formed of at least one spring whose one end is fixed to the frame and whose other end is fixed to the seat.

The slow-downer comprises: a casing whose one side is combined with the back support, and on one side of the inner surface of which an oil blocking wall is formed; a fixed unit on the outer circumferential surface of which one end of the oil blocking wall contacts and with the inner circumferential surface of which the hinge portion is combined, and on the outer circumferential surface of which at least one blade is formed to maintain a gap from the inner circumferential surface of the casing; an oil which is filled in a space formed between the casing and the fixed unit; and a seal unit which seals both side ends between the casing and the fixed unit.

BRIEF DESCRIPTION OF THE DRAWINGS

The above and other objects and advantages of the present invention will become more apparent by describing the preferred embodiment thereof in detail with reference to the accompanying drawings in which.

BEST MODE FOR CARRYING OUT THE INVENTION

Hereinbelow, a chair with a combination back support and cover plate according to the present invention will be described with reference to the accompanying drawings.

Figure 8:
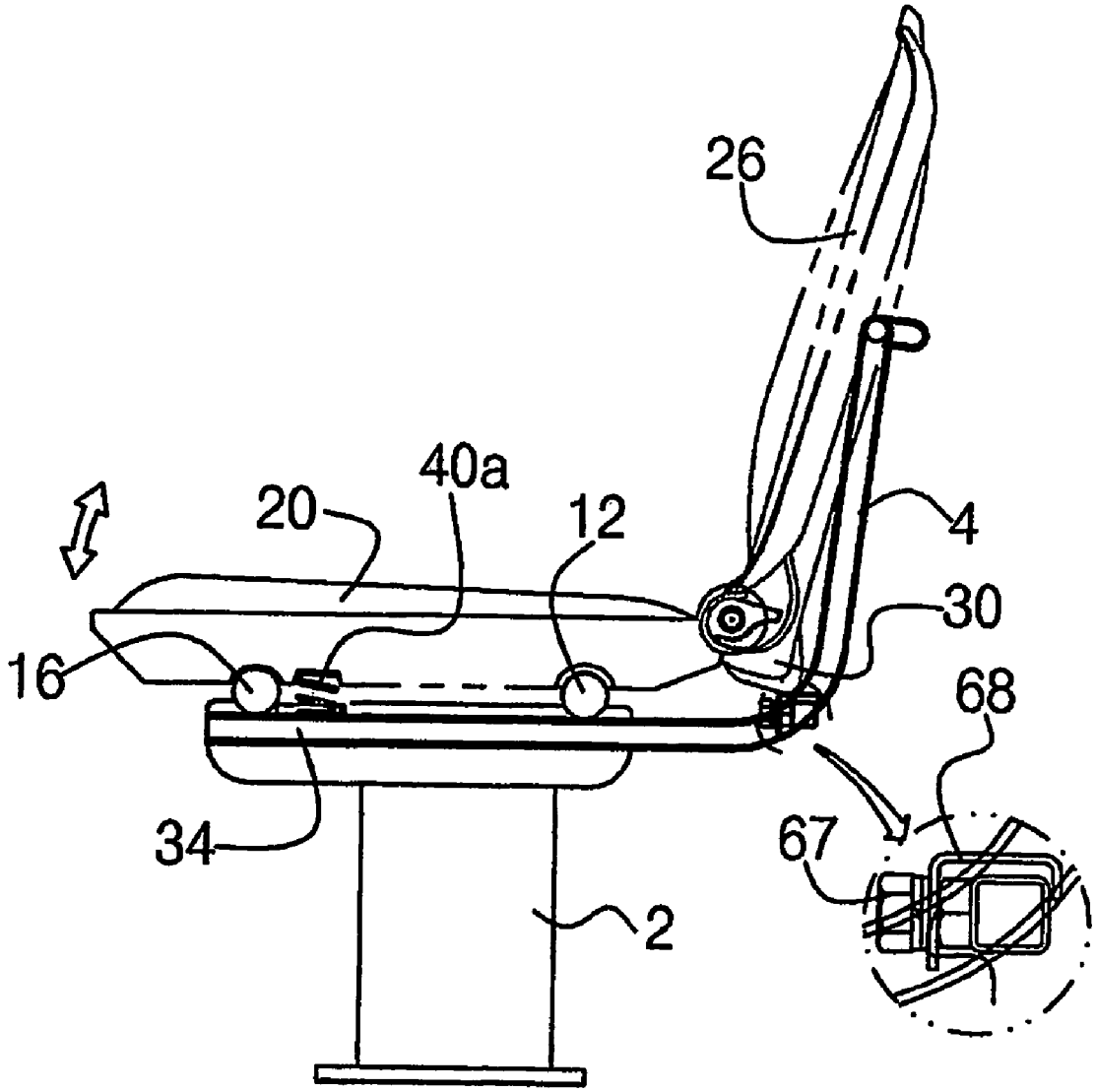
FIG. 8 is a side view for explaining structure of an elastic support unit in a chair with a combination back support and cover plate according to a second embodiment of the present invention.
Figure 9:
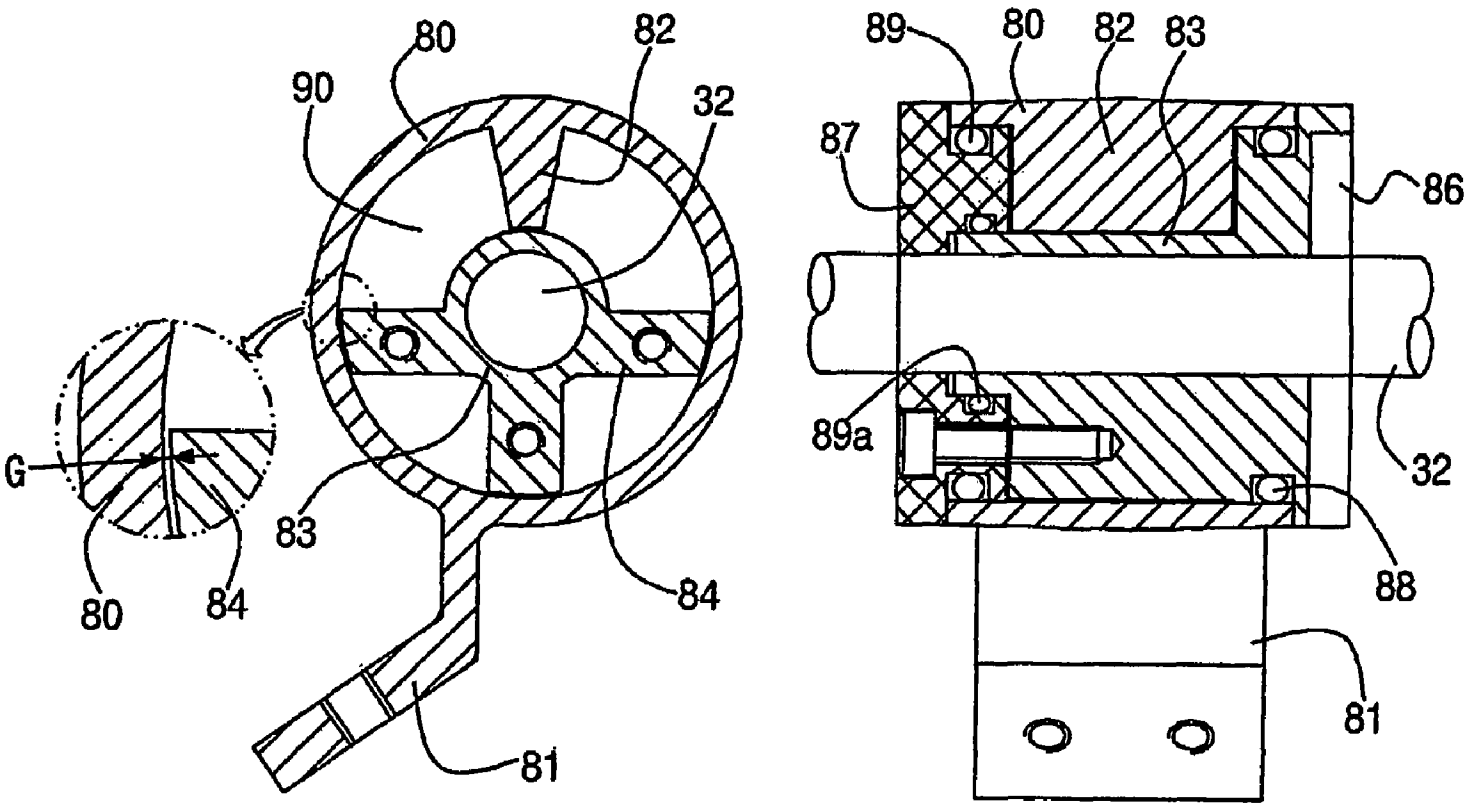
FIG. 9 is a cross-sectional view for explaining structure of a slow-downer in a chair with a combination back support and cover plate according to the second embodiment of the present invention.
Figure 10:
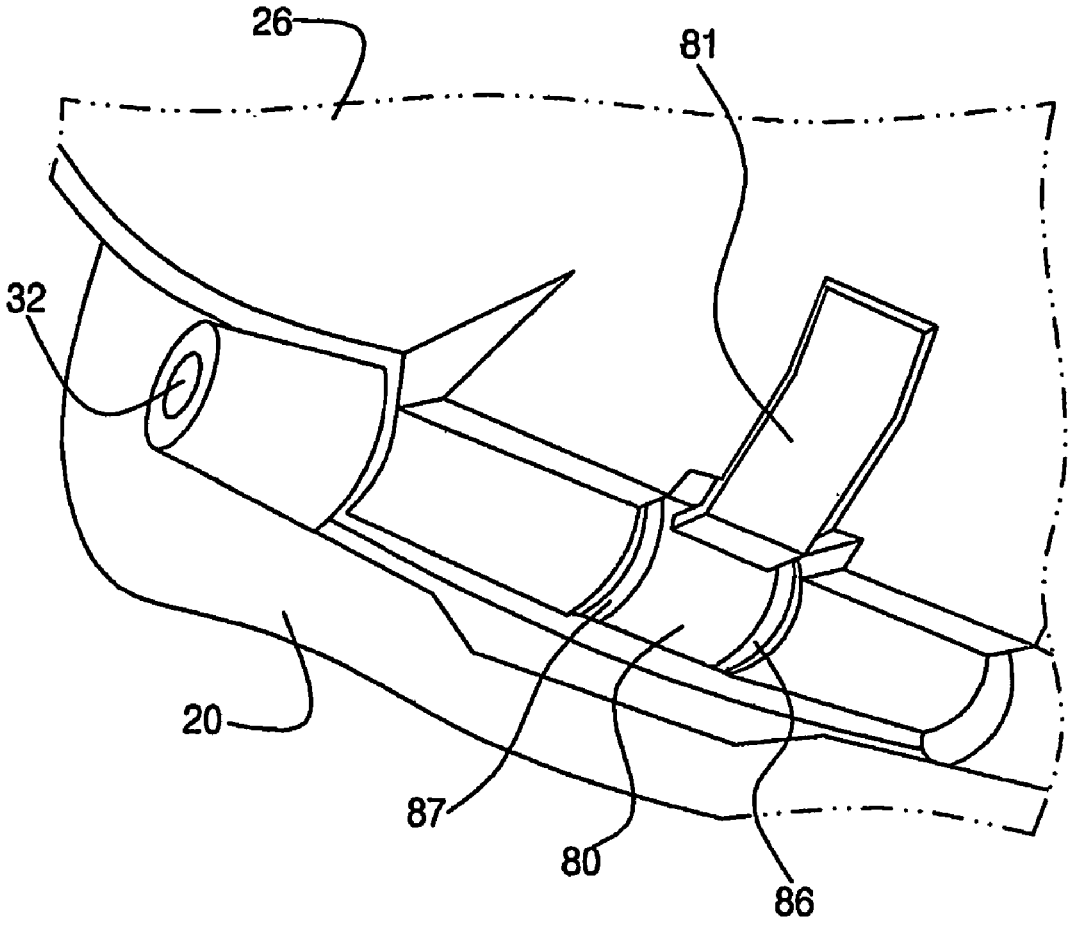
FIG. 10 is a partial perspective view for explaining position of installing the slow-downer in a chair with a combination back support and cover plate according to the second embodiment of the present invention.
Figure 11:
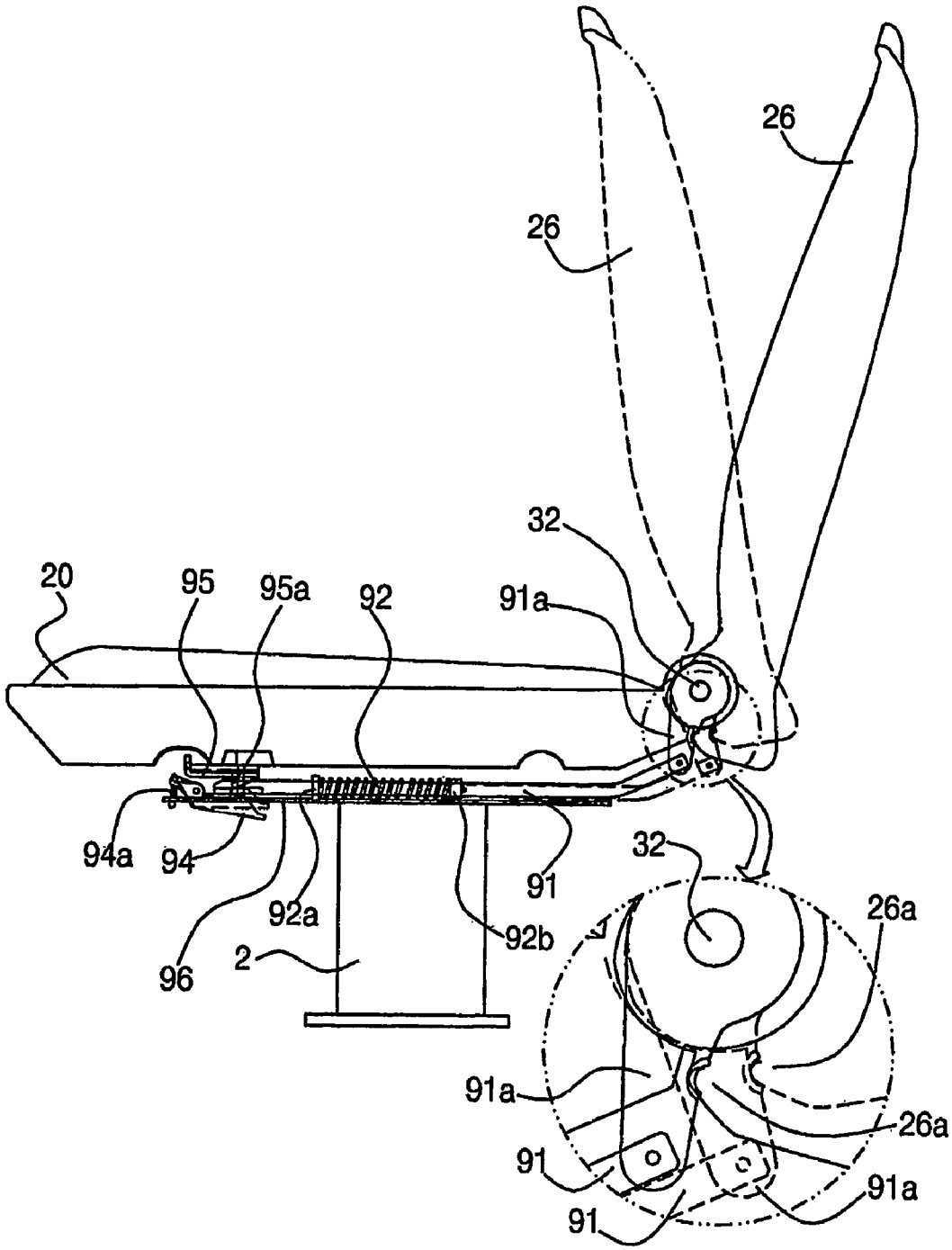
FIG. 11 is a front view for explaining a chair with a combination back support and cover plate according to a third embodiment of the present invention.
Figure 12:
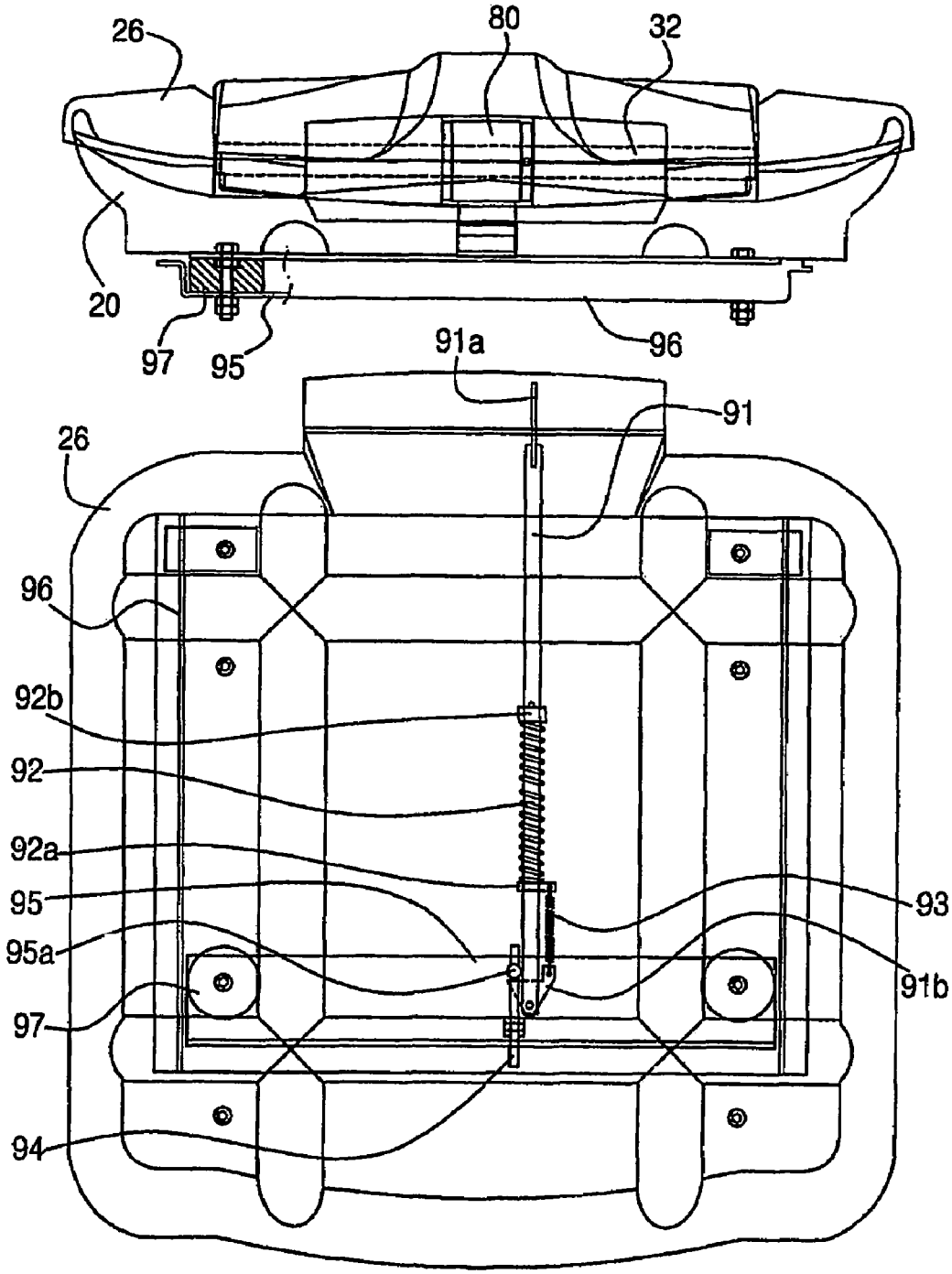
FIG. 12 is a bottom view for explaining a chair with a combination back support and cover plate according to the third embodiment of the present invention.

In the accompanying drawings, FIGS. 1 through 7 are provided to describe a chair with a combination back support and cover plate according to a first embodiment of the present invention, FIGS. 8 through 10 are provided to describe a chair with a combination back support and cover plate according to a second embodiment of the present invention, and FIGS. 11 and 12 are provided to describe a chair with a combination back support and cover plate according to a third embodiment of the present invention.

1. FIRST EMBODIMENT

As shown in FIGS. 1 through 7, in a chair with a combination back support and cover plate according to a first embodiment of the present invention, a support leg 2 is fixed on the ground. On the upper portion of the support leg 2 is installed a main frame 4 formed of a horizontal portion 6 and an inclined portion 8 which is extended with an inclined structure upwards from the rear end of the horizontal portion 6. On the upper end of the inclined portion 8 in the main frame 4 is installed a back support bar 10 for supporting a back support 26 horizontally in the lengthy direction.

Also, a seat 20 is disposed on the upper portion of the horizontal portion 6 in the main frame 4, and the back support 26 is hinged with the rear end of the seat 20 by a hinge pin 32. On the bottom of the front end of the seat 20 is formed a seat groove 22 in and from which a third support bar 16 to be described later is attached and detached. On the rear surface of the back support 26 is formed a back support groove 28 in which the back support bar 10 is safely mounted.

Also, on the central upper portion of the main frame 4 is fixedly combined a second support bar 12 which supports the seat 20 and simultaneously rotates the front side of the seat 20 up and down to play a role of a rotational axis. The second support bar 12 is horizontally fixedly supported so as to be perpendicular with the horizontal portion 6. The seat 20 is safely mounted on the upper portion of the second support bar 12.

Here, the seat 20 is rotatably combined with the second support bar 12 by means of a first clip 14 which is combined on the lower surface of the seat 20. This rotational structure is embodied by forming a groove with a curvature corresponding to the second support bar 12 at the central portion of the first clip 14 so that the lower outer circumferential surface of the second support bar 12 is supported on the inner circumferential surface of the first clip 14, at the state the former contacts the latter.

Further, a third support bar 16 is fixed on the front upper portion of the horizontal portion 6 in the main frame 4 so as to be perpendicular with the horizontal portion 6. The third support bar 16 is formed so that the upper surface of the third support bar 16 is inserted into or released from a seat groove 22 when the seat 20 rotates around the second support bar 12.

Meanwhile, a second clip 18 which is fixed on the bottom surface of the seat 20 is combined on the lower side of the seat groove 22 in the seat 20 so that both ends of the second clip 18 is adjacent to the seat groove 22. In this case, a groove portion corresponding to a curvature of the third support bar 16 is formed in the second clip 18 so that the lower surface of the third support bar 16 is inserted into and released from the central portion of the second clip 18.

In this case, the groove portion formed in the second clip 18 is formed in depth deeper than that of a groove portion formed in the first clip 14. The depth of the groove portion is established in depth corresponding to a predetermined angle for rotating the seat 20.

Further, the second clip 18 plays a role of limiting the seat 20 so that the front side of the seat 20 is prevented from rotating upwards by a predetermined angle or more around the second support bar 12 by means of an elastic support unit 40 to be described later.

Meanwhile, a number of fixed frames 34 are fixedly disposed at a predetermined interval in the lower portion of the third support bar 16 and the second support bar 12 so that the number of fixed frames 34 are perpendicular with the third support bar 16 and the second support bar 12.

Here, on the fixed frames 34 is formed a female screw portion 36 on the rear end of which a female screw is formed, respectively. A stopper 60 to be described later is engaged with the female screw portion 36.

Also, a plurality of elastic support units 40 which are installed on the plurality of fixed frames 34 are installed to elastically support the front lower surface of the seat 20 upwards. Accordingly, a user can use the seat 20 comfortably.

Figure 5:
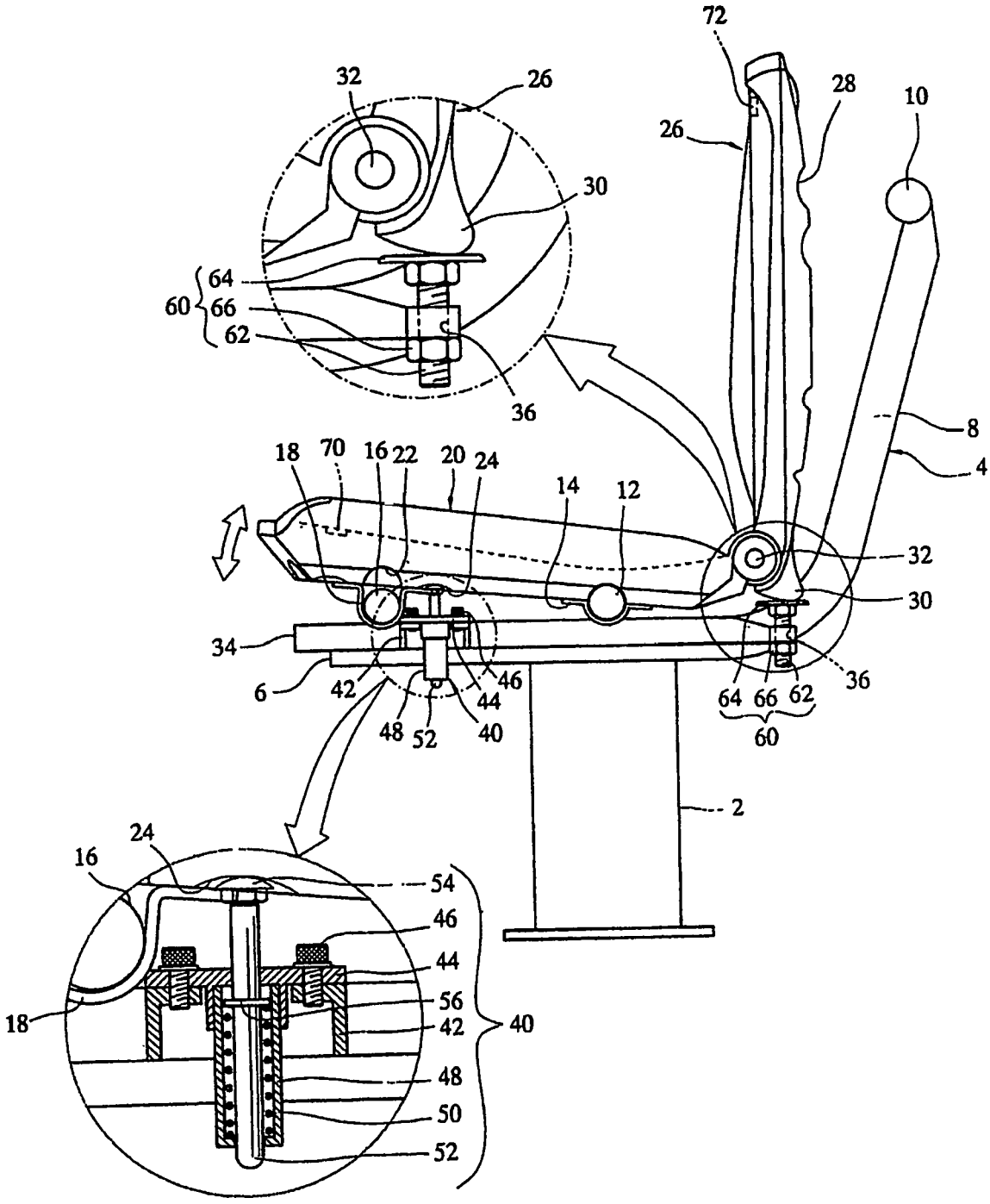
FIGS. 5 and 6 are side views for explaining a process that a back support is unfolded in a chair with a combination back support and cover plate according to the first embodiment of the present invention.

As shown in FIG. 5, each of the elastic support units 40 includes a bracket 42 which is installed in either side of the fixed frames 34. A cover 44 is engaged on the upper portions of the brackets 42 by means of a number of coupling bolts 46. Further, with the lower central portion of the cover 44 is combined a hollow spring case 48 in the inner side of which a coil spring 50 is inserted.

Also, each of the elastic support units 40 includes a pusher 52 which penetrates the lower end of the cover 44 and the spring case 48 in sequence vertically. On the upper end of the pusher 52 is formed a pusher head 54 which is mounted into a head groove 24 in the seat 20.

The pusher 52 is coupled with the cover 44 and the spring case 48 slidably at the state where the pusher 52 penetrates the cover 44 and the spring case 48 in sequence. A protruded pressing portion is formed around the central portion of the pusher 52. Accordingly, the protruded pressing portion is elastically supported on one side of the spring 50 which is inserted in the spring case 48. As a result, the pusher head 54 pushes the front portion of the seat 20 upwards at the state where the pusher head 54 closely supported on the inner circumferential surface of the head groove 24 in the seat 20.

Meanwhile, in the lower portion of the back support 26 is protrudingly installed a knob 30 which supplementarily assists a main function of the chair with a combination back support and cover plate according to the present invention.

Also, a stopper 60 by which the lower end of the knob 30 is supported is engaged in a female screw portion 36 which is positioned in the rear end of the fixed frame 34. The stopper 60 has a structure that a distance from the stopper 60 to the knob 30 can be adjusted.

That is, the stopper 60 includes a male screw portion 62 which is engaged with the female screw portion 36 in the fixed frame 34, a nut 66 which is engaged with the male screw portion 62 positioned in the lower side of the female screw portion 36, to thus limit rising of the male screw portion 62, and a stopper head 64 which is engaged with the male screw portion 62 which is positioned in the upper portion of the female screw portion 36 to thus support the bottom surface of the knob 30.

Also, a permanent magnet 72 is fixed in the inner surface of the front upper portion of the back support 26, and a steel iron plate 70 which is installed in opposition to the permanent magnet 72 is fixedly provided in the front upper surface of the seat 20 to adhere to the permanent magnet 72. Accordingly, when the back support 26 is folded on the seat 20, the steel iron plate 70 is attached to the permanent magnet 72, to thereby prevent the back support 26 from being opened due to wind and thus prevent the seat 20 from being polluted.

Figure 1:
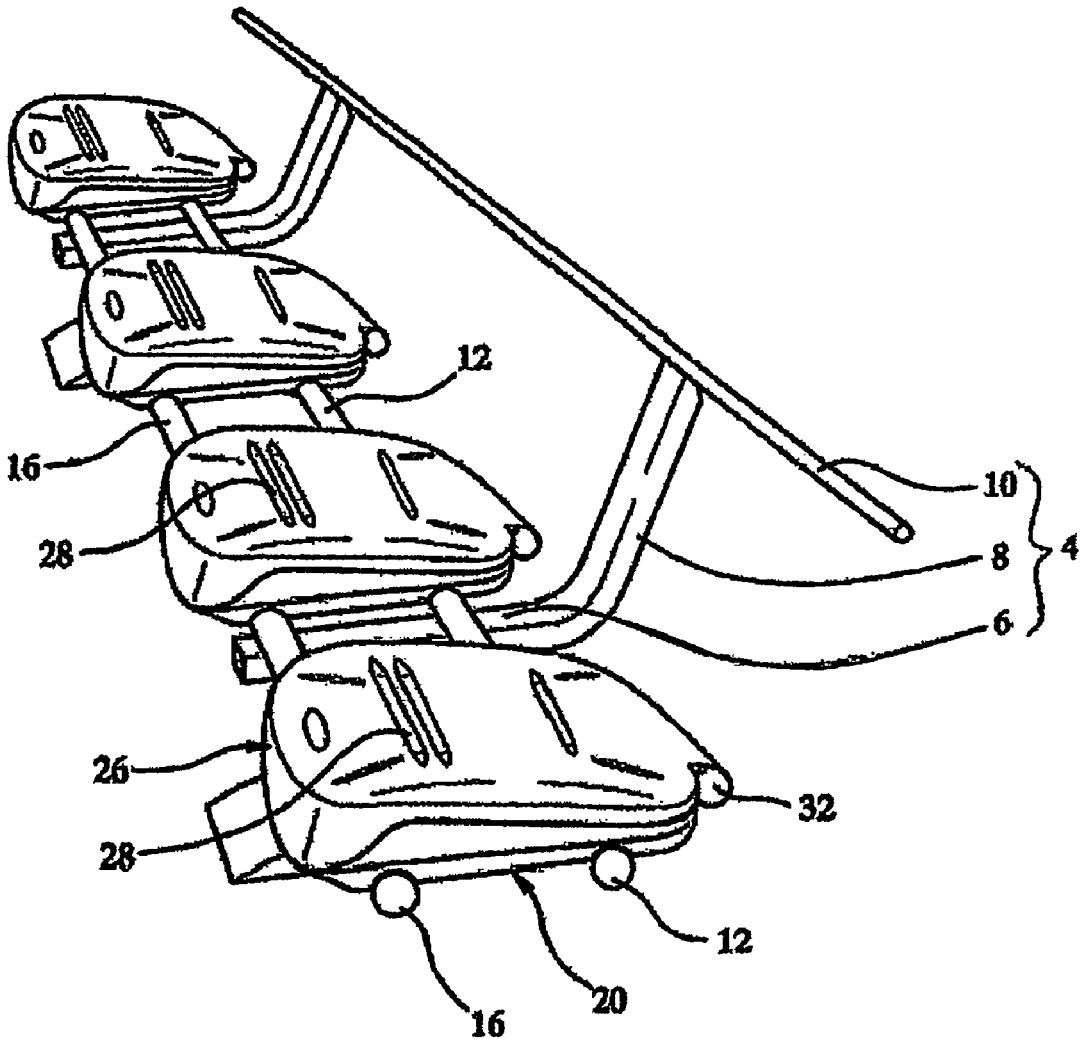
FIG. 1 is a perspective view showing a state where a back support is folded on a seat in a chair with a combination back support and cover plate.
Figure 2:
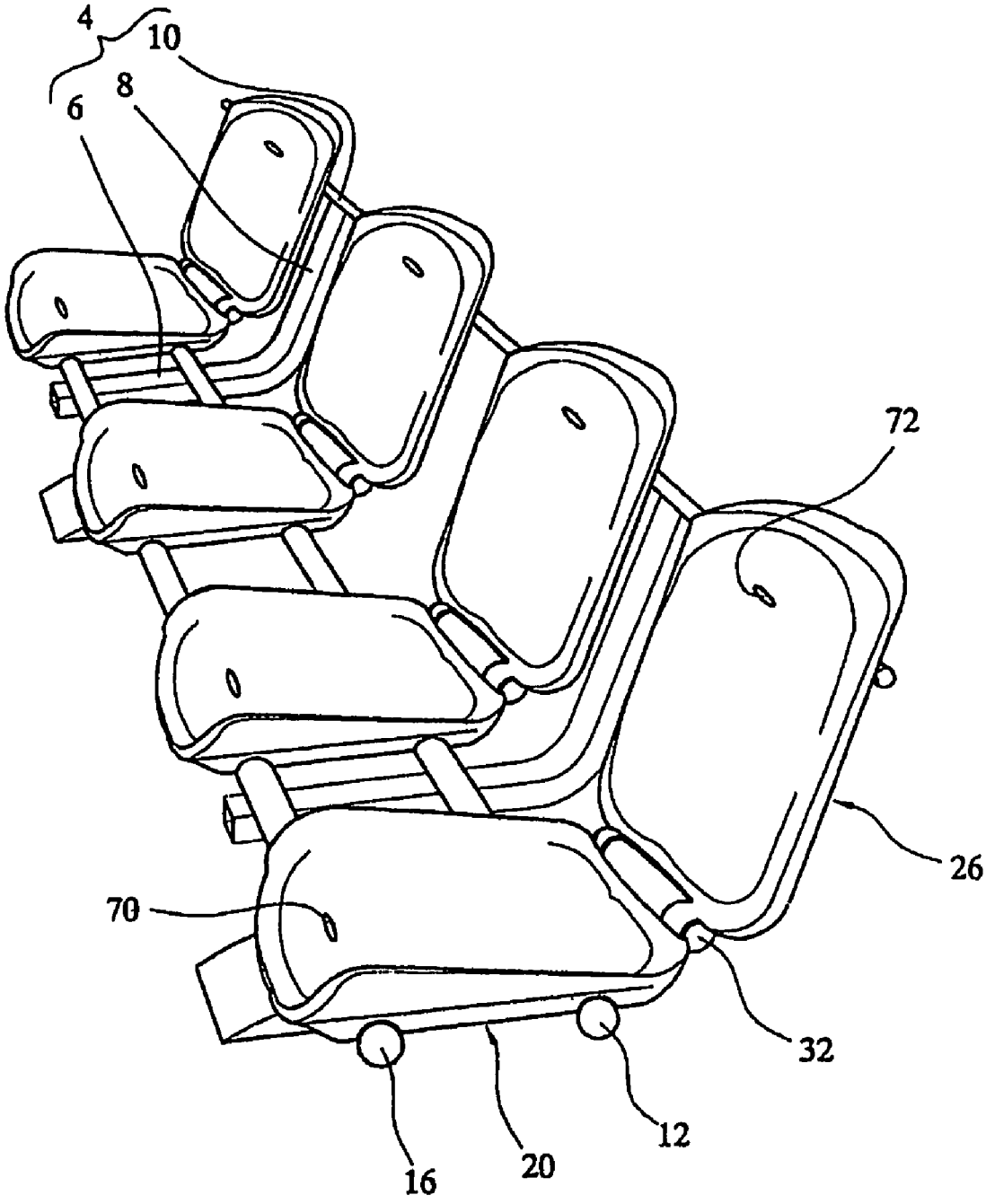
FIG. 2 is a perspective view showing a state where a back support is unfolded on a seat in a chair with a combination back support and cover plate.
Figure 3:
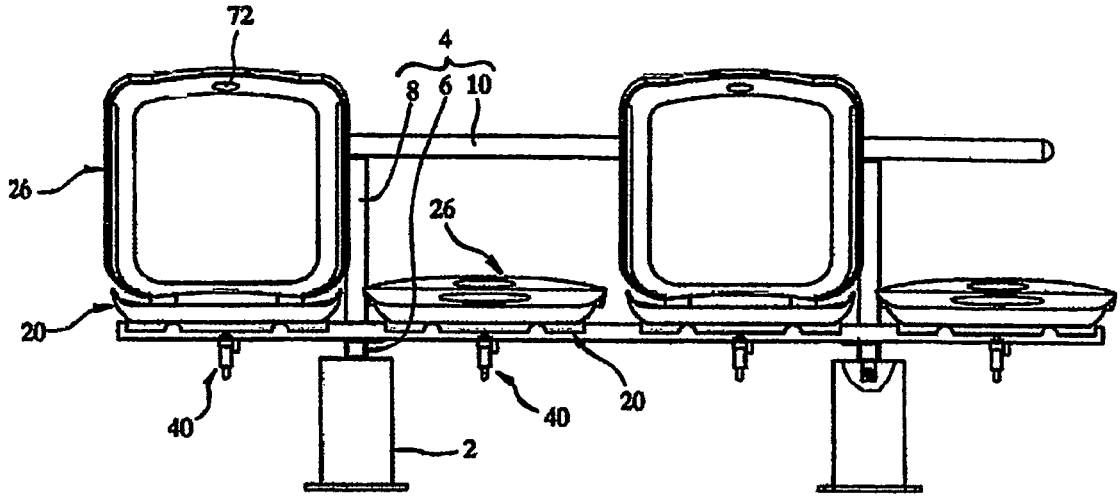
FIG. 3 is a front view for explaining a chair with a combination back support and cover plate according to a first embodiment of the present invention.
Figure 4:
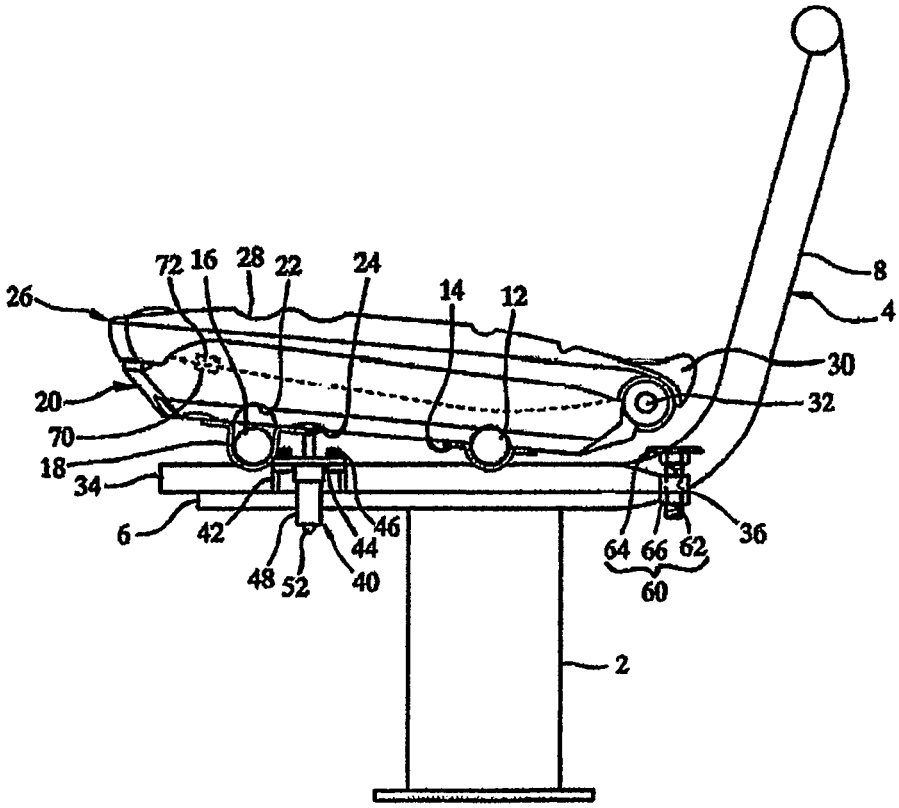
FIG. 4 is a side view showing a state where aback support is folded on a seat in a chair with a combination back support and cover plate according to the first embodiment of the present invention.

In the case of the chair with a combination back support and cover plate according to the first embodiment of the present invention having the above-described structure, when the seat 20 is raised up as shown in FIG. 5 in order to sit on the seat 20 at the state where the back support 26 is closed on the seat 20 as shown in FIG. 4, the knob 30 in the back support 26 is supported by the stopper head 64. In this state, although a user releases his or her hand from the back support 26, an angle formed by the back support 26 and the seat 20 is maintained at substantially 90 degrees upright.

Thus, even if a user raises up the back support 26 and then releases his or her hand therefrom, the back support 26 is not closed on the seat 20, that is, the back support 26 is not folded on the seat 20.

Therefore, the chair with a combination back support and cover plate according to the present invention solves inconveniences that users suffer from the conventional foldable chair employing the back support 26 that should be held by at least one hand, to thereby greatly enhance conveniences and quality of products.

Figure 6:
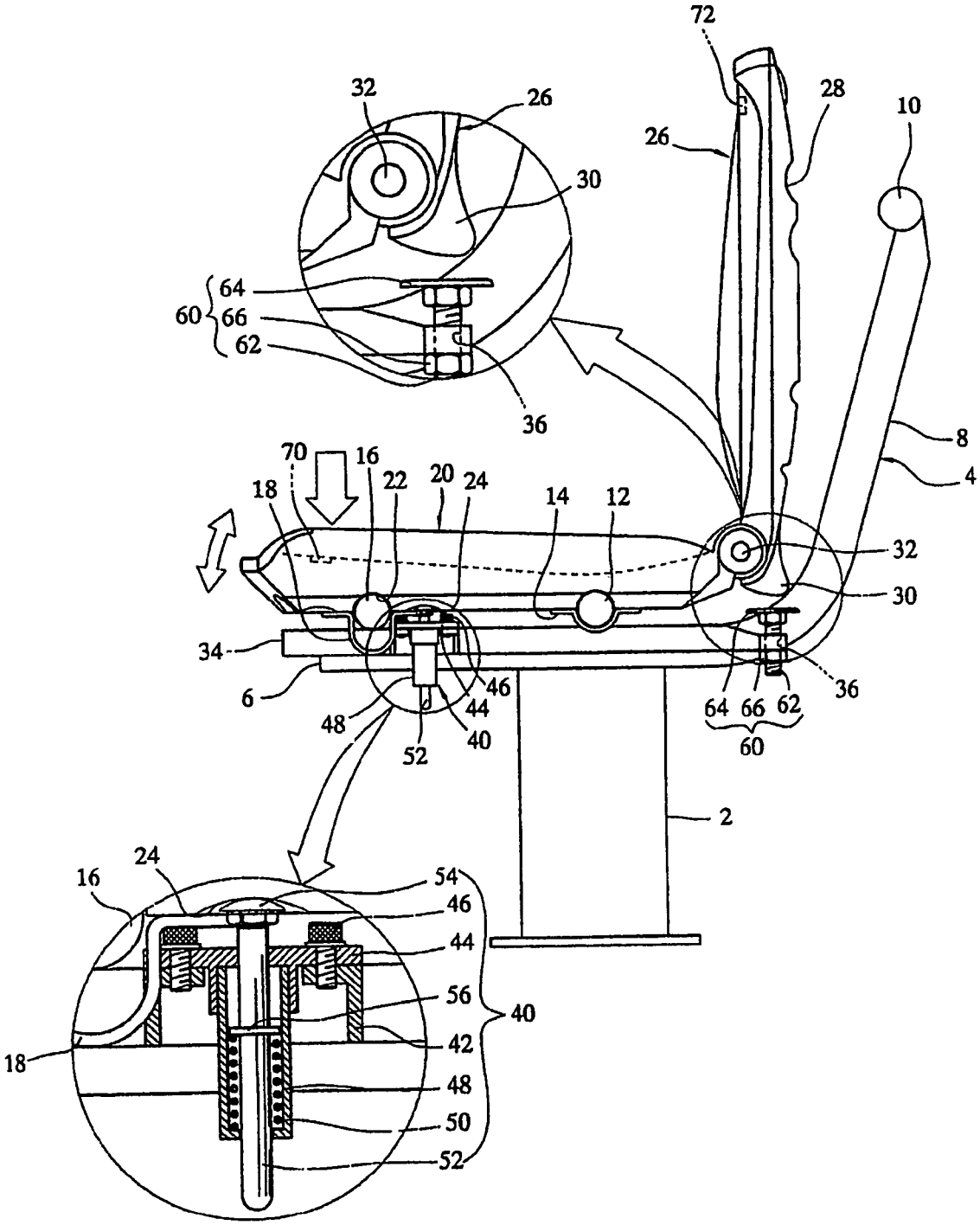
Figure 7:
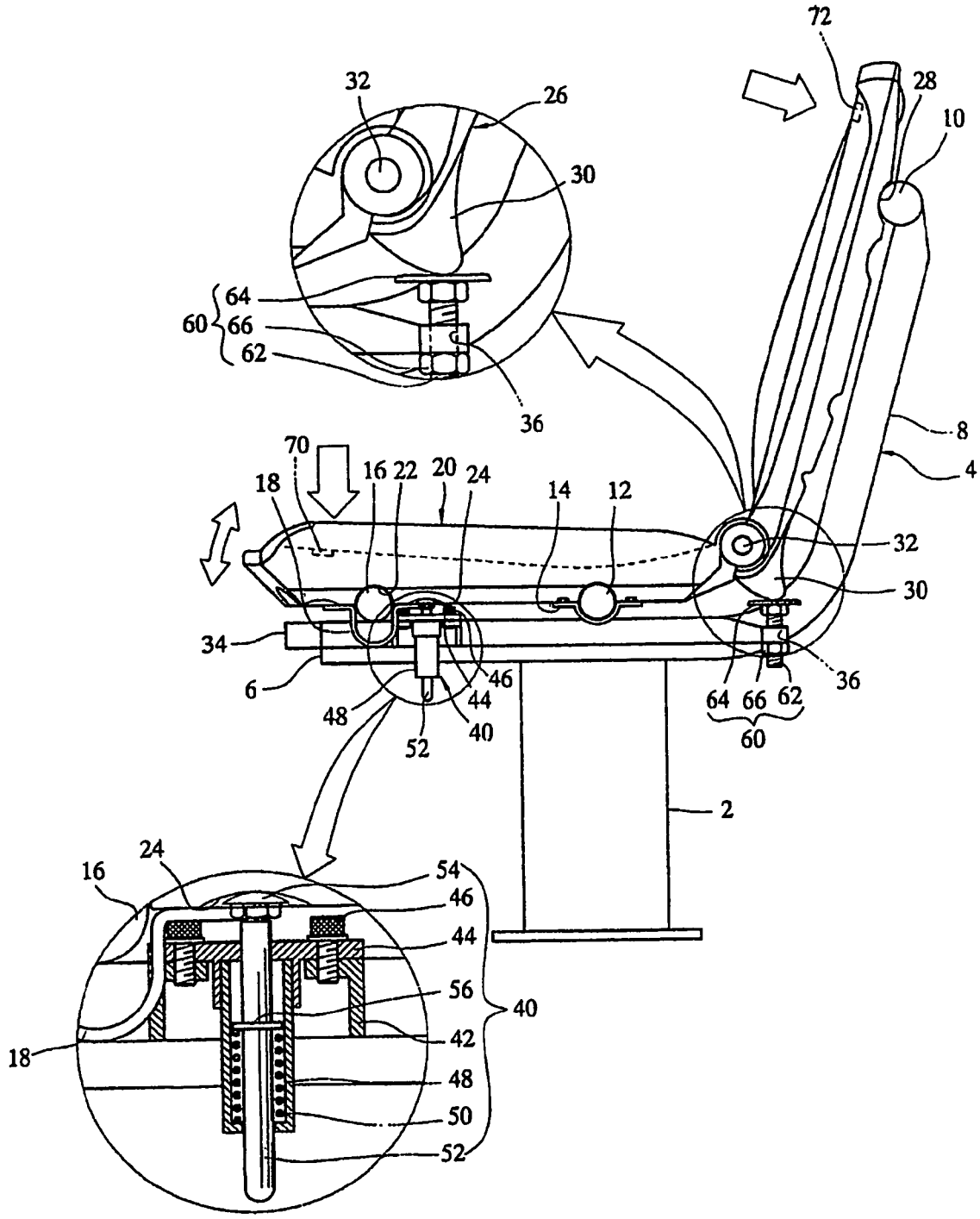
FIG. 7 is a side view showing a state where aback support is completely unfolded in a chair with a combination back support and cover plate according to the first embodiment of the present invention.

Meanwhile, when a user sits on the seat 20 at the state where the back support 26 is opened or unfolded as shown in FIG. 5, the front side of the seat 20 is descendant around the second support bar 12 and the elastic support unit 40 presses the pusher 52 to compress the spring 50, as shown in FIG. 6. As a result, the upper portion of the third support bar 16 contacts and is supported on the inner circumferential surface of the seat groove 22, to accordingly limit rotation of the seat 20.

Then, as the seat 20 is rotated around the second support bar 12, the back support 26 positioned in the rear end of the seat 20 is raised up as shown in FIG. 6, and thus the knob 30 in the back support 26 goes far from the stopper head 64.

Therefore, when a user who wants to sit on a seat 20 leans against the back support 26, the back support 26 is rotated further in the rear direction therefrom. Thus, a back support groove 28 is supported by a back support bar 10 and simultaneously the knob 30 contacts and is supported on the stopper head 64. As a result, rotation of the back support 26 is limited, to thereby have a user sit on the seat 20 while comfortably leaning against the back support 26.

Meanwhile, when a user stands up from the seat 20 after use of the seat 20, the compressed spring 50 is restored to allow the pusher 52 and the pusher head 54 to rise up. Accordingly, the front end of the seat 20 is rotated upwards and thus the lower end of the back support 26 is descendant around the second support bar 12. As a result, the knob 30 is pushed by the stopper head 64 and the back support 26 is rotated around the hinge pin 32. Then, when an angle formed by the seat 20 and the back support 26 is acute, the back support 26 is folded due to its own weight as shown in FIG. 4.

As described above, since the present invention allows the back support 26 to be automatically folded on the seat 20, at the same time when a user stands up from the seat 20, it facilitates management of the seat.

Also, since the elastic support unit 40 provides the seat 20 with elasticity, shock due to sitting is reduced to thereby allow a user to feel comfortable at the time of sitting. Also, the elastic support unit 40 mitigates shock occurring when the back support 26 is closed on the seat 20 due to its own weight.

2. SECOND EMBODIMENT

As shown in FIGS. 8 through 10, a chair with a combination back support and cover plate according to a second embodiment of the present invention, includes an elastic support unit and a stopper differing from those of the first embodiment and further includes a slow-downer installed between the hinge pin 32 and the back support 26. The other components other than the above-described elastic support unit, stopper, and slow-downer in the second embodiment are very similar to those of the first embodiment.

An elastic support unit is installed between a fixed frame 34 and a seat 20, and uses a spring 40*a* which is a kind of a compression spring.

That is, one end of the spring 40*a* contacts the lower surface of the seat 20, and the other end of the spring 40*a* is fixed to the fixed frame 34.

The elastic support unit according to the second embodiment is simpler in construction than the elastic support unit 40 of the first embodiment but the former provides the same effect as that of the latter, to thereby enhance productivity.

As shown in FIG. 8, the stopper according to the second embodiment includes a bolt 67 which is coupled with a main frame 4 by means of a screw, and a plate 68 which is bent so as to contact the knob 30 at an appropriate angle and coupled with the fixed frame 34 by the bolt 67.

A lengthy groove is formed at the portion where the plate 68 is engaged with the bolt 67, and thus position of the plate 68 can be changed to thereby adjust a gap between the knob 30 and the plate 68.

As shown in FIGS. 8 and 9, the slow-downer uses oil 90 in order to prevent the back support 26 from being closed or folded on the seat 20 with a mechanical shock due to its own weight. Accordingly, since the back support 26 is slowly closed or folded on the seat 20 by use of oil 90, damage or noise generation due to shock of the back support 26 can be prevented.

As shown in FIG. 8, the slow-downer includes a casing 80, a fixed portion 83 which is fixed to the hinge pin 32 and coupled with the inside of the casing 80, and oil 90 filled in the space formed between the casing 80 and the fixed portion 83.

The casing 80 is cylindrically formed. A blocking wall 82 is formed in one side of the inner circumferential surface of the casing 80 and a fixed plate 81 which is fixed to the rear surface of the back support 26 is formed in one side of the outer circumferential surface of the casing 80.

The hinge pin 32 is fixed to the center of the fixed portion 83. The outer circumferential surface of the fixed portion 83 are formed to contact the blocking wall 82. In one side of the circumferential surface of the fixed portion 83 are formed three blades 84 maintaining a small gap (G) from the inner circumferential surface of the casing 80, in which two blades are distant by one-hundred eighty (180) degrees from each other and the other blade is formed between the two 180-degree distant blades.

In this embodiment, three blades 84 are formed, but since a corresponding force should be sufficiently formed by means of relationship with the oil 90, so that the back support 26 becomes folded slowly, the structure of the blades can vary according to weight of the back support 26.

Both side ends of the casing 80 and the fixed portion 83 are sealed by first and second caps 86 and 87. Here, since the casing 80 is rotatably combined with the fixed portion 83, the first and second caps 86 and 87 are sealed by O-rings 88, 89, and 89*a*, respectively.

In this embodiment, a descending speed of the back support 26 can be determined by a gap (G) formed between the inner circumferential surface of the casing 80 and the blades 84. However, if the gap (G) is constant, the descending speed of the back support 26 can be slowly descendant by thickening adhesiveness of the oil 90, or quickly descendant by thinning adhesiveness of the oil 90.

3. THIRD EMBODIMENT

As shown in FIGS. 11 and 12, a chair with a combination back support and cover plate according to a third embodiment of the present invention, includes a closing unit which closes a back support 26 differing from those of the first and second embodiments. The other components other than the above-described closing unit in the third embodiment are very similar to those of the first and second embodiments.

The closing unit in the third embodiment includes a link 91*a* whose one end is rotatably connected with the hinge pin 32 and contacts a knob 26*a* formed in the lower end of the back support; a pushing rod 91 on one end of which the fixing unit 91*b* is formed and with the other end of which the link 91*a* is connected; a spring 92 which is mounted on the pushing rod 91; a spring stopper 92*a* to one end of which the frame 96 is fixed and to the other end of which one end of the spring 92 is fixed, to thereby support the pushing rod 91; a rod stopper 91*a* which is connected with the other end of the spring 92 and fixed to the pushing rod 91; a hook 94 which is installed in the frame 96 and is connected with the fixing unit 91*b* which is formed in one end of the pushing rod 91; a hook spring 94*a* which is connected between one end of the hook 91 and the frame 96, for pulling the hook 94 toward the seat 20; and a hook release unit 95 and 95*b* which is installed below the seat 20 and separates the hook 94 from the fixing unit 91*b* in the pushing rod 91 by a user's weight when a user sits on the seat.

The hook release unit includes a plate 95 connected with the lower end of the seat 20, and a pusher 95*a* which is connected with the plate 95 positioned in correspondence to the hook 94, for pushing the hook 94 downwards.

The fixed unit 91*b* is installed in one end of the pushing rod 91. In order to have one end of the pushing rod 91 easily engaged with the hook 94 when the pushing rod 91 moves toward the front end of the seat 20, the fixing unit 91*b* is installed toward one end of the pushing rod 91 in the form of a streamline, in which each end of the fixing unit 91*b* is hinged so that the hook 94 is engaged with one side of the fixing unit 91*b* and a tensile spring 93 which is connected with the spring stopper 92*a* is installed in the other side thereof, to thereby pull the fixing unit 91*b*.

In the third embodiment of the present invention, an elastic member 97 which is an elastic support unit is installed across both ends of the frame 96 and between the plate 95 installed toward the front end of the seat 20 and the front end of the seat 20, above the frame 96. The elastic member 97 is made of rubber or synthetic resin having an excellent elastic restoring force, differently from the springs used in the first and second embodiments.

INDUSTRIAL APPLICABILITY

As described above, in the case of the chair with a combination back support and cover plate according to the present invention including a seat and a back support, the seat is protected by using the back support when the seat is not occupied by a user. The present invention provides a seat with an elastic force to make a comfortable sitting state, and makes a back support being folded at low speed at the process of automatically covering the upper surface of the seat with the back support after use of the seat, to thereby reduce a management cost of the chairs.

Also, the present invention prevents the chair from being damaged and causing noise to be generated due to the mechanical shock which may happen between the back support and the seat when the back support is closed on the seat at high speed by its own weight.

As described above, the present invention has been described with respect to particularly preferred embodiment. However, the present invention is not limited to the above embodiment, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

The invention claimed is:

1. A chair with a combination back support and cover plate comprising:

a frame whose lower part is fixed to another object;

a seat which is installed on an upper portion of the frame;

a back support which is hinged and connected with one end of the seat;

a hinge portion which connects the seat and the back support by means of a hinge connection;

an elastic support unit which is installed between the seat and the frame, for elastically supporting the seat;

a closing unit which pulls the back support toward the seat if the front end of the seat moves up by the elastic support unit when a user stands up from the seat; and a slow-downer which is connected with the hinge portion and the back support, to slow down the pulling of the back support during the pulling of the back support towards the seat.

2. The chair with a combination back support and cover plate according to claim 1, wherein the closing unit comprises: a support unit which is installed in the lower middle portion of the seat so that the rear end of the seat moves up and down reversely when the front end of the seat moves up and down by the elastic support unit and a user's weight; a knob which protrudes in the lower end of the back support; and a stopper which is installed in the frame at the position where the knob contacts at the state that the back support has been unfolded.

3. The chair with a combination back support and cover plate according to claim 2, wherein the stopper is formed of a bolt which is combined with the frame by means of a screw so that a gap between the knob and the stopper can be adjusted, and one end of the stopper can contact the knob.

4. The chair with a combination back support and cover plate according to claim 2, wherein the stopper is formed of a plate which is installed in the frame so as to adjust a gap between the knob and the stopper and contacts the knob, and a fixing unit which movably fixes the plate to the frame.

5. The chair with a combination back support and cover plate according to claim 1, wherein the closing unit comprises: a link whose one end is rotatably connected with the hinge portion and contacts the lower end of the back support; a pushing rod on one end of which a fixing unit is formed and with the other end of which the link is connected; a spring which is mounted on the pushing rod; a spring stopper to one end of which the frame is fixed and to the other end of which one end of the spring is fixed, to thereby support the pushing rod; a rod stopper which is connected with the other end of the spring and fixed to the pushing rod; a hook which is installed in the frame and is connected with the fixing unit which is formed in one end of the pushing rod; a hook spring which is connected between one end of the hook and the frame, for pulling the hook toward the seat; and a hook release unit which is installed below the seat and separates the hook from the fixing unit in the pushing rod by a user's weight when a user sits on the seat.

6. The chair with a combination back support and cover plate according to claim 1, further comprising a limit unit which limits a moving range by the elastic support unit between the front end of the seat and the frame.

7. The chair with a combination back support and cover plate according to claim 1, further comprising a magnet or magnetic body which is installed in the seat and the back support, respectively.

8. The chair with a combination back support and cover plate according to claim 1, wherein the elastic support unit comprises: a housing to the upper end of which the fixed frame is fixed; a spring which is installed in the inside of the housing; and a pusher which is directed toward the seat by the spring.

9. The chair with a combination back support and cover plate according to claim 1, wherein the elastic support unit is formed of at least one spring whose one end is fixed to the frame and whose other end is fixed to the seat.

10. The chair with a combination back support and cover plate according to claim 1, wherein the slow-downer comprises: a casing whose one side is combined with the back support, and on one side of an inner surface of which an oil blocking wall is formed; a fixed unit on the outer circumferential surface of which one end of the oil blocking wall contacts and with the inner circumferential surface of which the hinge portion is combined, and on the outer circumferential surface of which at least one blade is formed to maintain a gap from the inner circumferential surface of the casing; oil filled in a space formed between the casing and the fixed unit; and a seal unit which seals side ends between the casing and the fixed unit.

* * * * *